United States Patent [19]

McMackin et al.

[11] 3,940,819

[45] Mar. 2, 1976

[54] HYDRAULIC POWERED HANDWASHER

[76] Inventors: Raymond F. McMackin, 171 Mount Pleasant Road, Smithtown, N.Y. 11787; Richard B. Britton, 60 Dyke Road, Setauket, N.Y. 11733; Kenneth E. Robins, 6 Shirley St., Center Moriches, N.Y. 11934

[22] Filed: Nov. 21, 1973

[21] Appl. No.: 418,090

[52] U.S. Cl. ..... 15/21 C; 15/75; 91/498

[51] Int. Cl.[2] ..... A47K 7/04

[58] Field of Search ..... 15/21 R, 21 C, 21 D, 75, 15/76, 74, 211, 97 R; 4/184; 137/562; 91/498

[56] References Cited

UNITED STATES PATENTS

| | | | |
|---|---|---|---|
| 602,190 | 4/1898 | Evans | 15/75 |
| 914,717 | 3/1909 | Hacker | 15/76 |
| 1,641,494 | 9/1927 | Joseph | 15/24 |
| 2,094,161 | 9/1937 | Paddock | 137/562 X |
| 2,794,196 | 6/1957 | Koeppe | 15/75 |

FOREIGN PATENTS OR APPLICATIONS

| | | | |
|---|---|---|---|
| 685,669 | 4/1930 | France | |
| 1,132,766 | 11/1956 | France | 15/211 |
| 647,781 | 12/1950 | United Kingdom | 91/498 |

*Primary Examiner*—Edward L. Roberts

[57] ABSTRACT

A liquid-powered device is provided for washing the terminal-end portion of an elongated member, such as a hand, extended therein. Liquid, under pressure, energizes a positive-displacement motor which powers a rotational laving element wetted by the liquid after it has exited the motor. A housing which confines, collects, and vents used liquid has an entrance opening for entry of the terminal-end portion of an elongated member into washing relationship with the laving element. Provision can be made for supplying soap and the like in solid or liquid form within the housing.

9 Claims, 14 Drawing Figures

HYDRAULIC POWERED HANDWASHER

BACKGROUND OF THE INVENTION

Children are notoriously reluctant to wash their hands to standards of cleanliness acceptable to most adults. As a consequence, many parents resort to coercion, bribery, and the like to assure that their children will clean their hands before eating or upon entering the house after outdoor activities. The frustrating confrontations which often result from these conflicting attitudes on hand cleanliness can be avoided if the process of washing hands is changed from an odious and forced task to something children regard as pleasurable or fun.

One way of achieving this desired change of attitude is through use of a handwashing device which children will think of as a toy, and which they will want to use without parental prodding.

In this context, a handwashing device should satisfy certain desiderata in order to be accepted by both parent and child. Parental concern is centered around such factors as safety, cost, and convenience, whereas the child is only concerned with the availability of the device and the fact that it is fun to use.

First, and foremostly, the handwasher must be absolutely safe to use. It cannot have any foreseeable potential for harming its user. This requires that the device not use electricity in any manner whatsoever. It also means that the handwasher should have a safeguard against inadvertent use of scalding water.

The handwasher should be relatively inexpensive. Its initial cost should not be high. It should have a long service-life with minimal need for repair. This implies that the handwasher be of simple rugged construction without failure-prone components such as gears and the like.

Installation and removal of the handwasher should not call for special expertness or require complicated or time-consuming effort. After initial installation, the handwasher should not require parental intervention or close supervision for its continued use. It should be compatible with the routine of normal household operation. This requires that the handwasher be readily installable and removeable at or adjacent a kitchen or lavoratory sink without any need for special plumbing. Once installed, it should present no significant inconvenience to the normal use of these facilities. Ideally, the handwasher should be of a nature such that it can remain in position for use at all times, or be quickly removed and replaced as desired without use of tools.

SUMMARY OF THE INVENTION

The above outlined desiderata are substantially met by the handwashing device of the instant invention which can be removably connected at will to a conventional faucet at a bathroom or kitchen sink to provide tempered water selectively to the sink or to direct water through the handwasher prior to return to the sink. Tempered water is selectively directed to the handwasher upon activation of a flow-diversion valve, which valve may be of the fail-safe type in which interruption of flow therethrough resets the valve automatically to its initial condition, in which condition all water is directed to the sink. Water, selectively directed to the handwasher, enters a positive-displacement hydraulic motor which provides power to a rotational laving member, ideally comprising bristlelike elements, which laving member is wetted by water exiting the hydraulic motor. The hydraulic motor and the rotational laving member are supported and enclosed within a housing having an access-opening permitting limited entry of a child's hand for washing purposes. In addition to supporting the motor and the laving member, the housing confines and collects liquid and spray resulting from the interaction between the rotational laving member and the water exiting the hydraulic motor and provides an exit for drainage of the water therefrom.

Provision is made for supplying solid or liquid soap or detergent and the like, as desired, continuously or on demand.

The handwasher of this invention includes a base support structure utilizing suction, which structure allows the handwasher to be removably mounted, as desired, in a sink or on a counter or vanity surface adjacent a sink, so as to be available without undue interference with the normal functions of the lavoratory, bathroom, and kitchen facilities.

The housing, in addition to its functional structural utility, can have its exterior surface appearance adapted to present the aspect of a familiar toy: an animal such as a duck, fish, or whale, which is associated with water; or a familiar cartoon character, so that a child will associate the handwasher with a source of pleasure.

A principal object of this invention is to provide a new and novel water-powered handwashing device which is inherently safe, is of simple, rugged construction, is economical to produce, can be installed easily without special tools, and which will be acceptable to both parents and children. Other objects and advantages of this invention will become obvious through reference to the accompanying drawings and description of the preferred embodiments of this invention.

DESCRIPTION OF THE PREFERRED EMBODIMENTS

Figure 1:
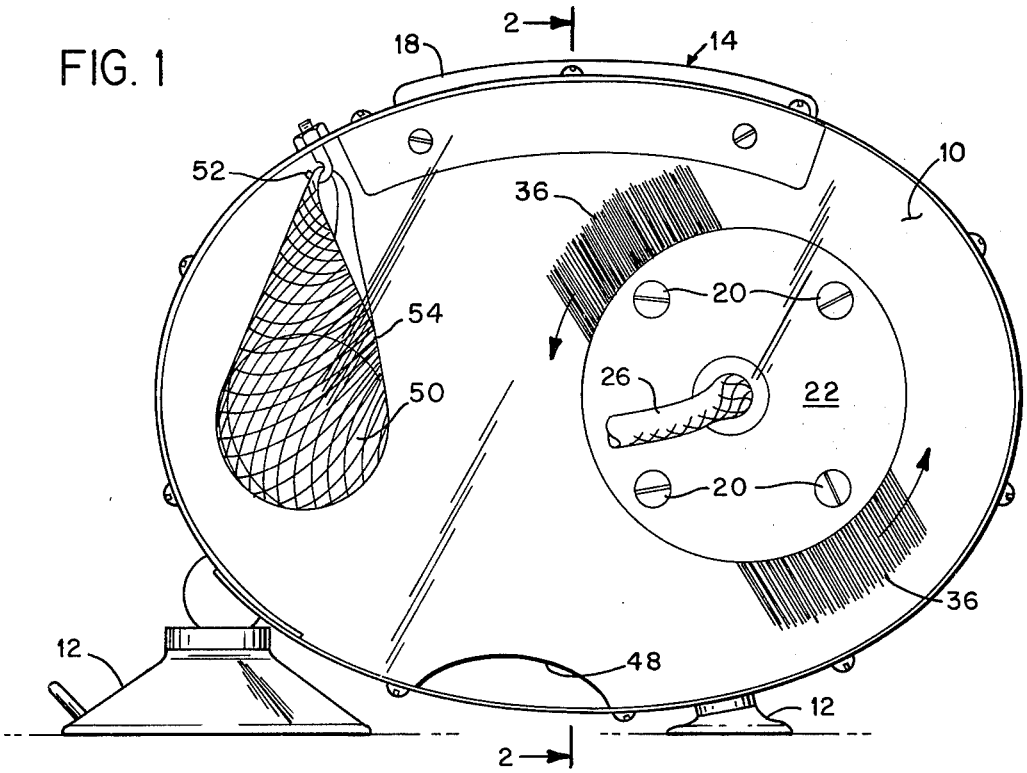
FIG. 1 is an elevation view of a handwasher of this invention whose side walls are of transparent synthetic plastic material.
Figure 2:
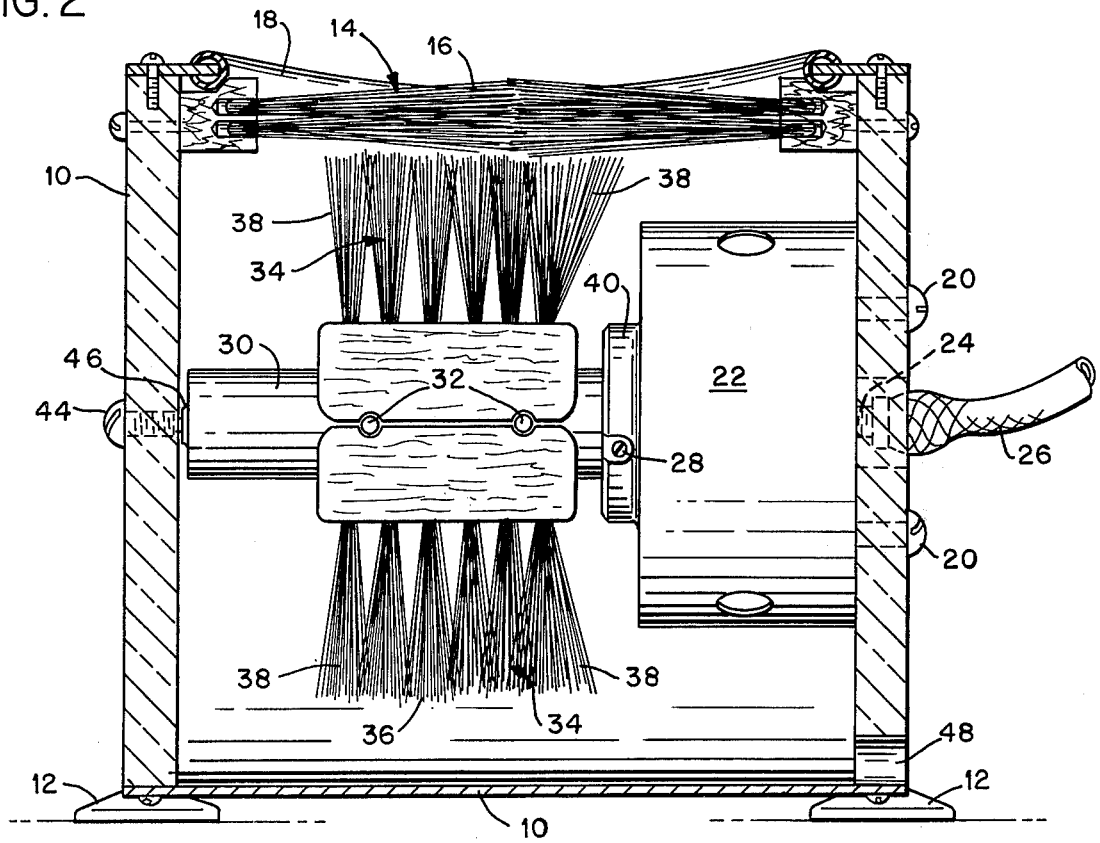
FIG. 2 is a sectional view taken along the plane at 2—2 of FIG. 1.

In the drawings, wherein like reference characters refer to like elements, FIG. 1 and FIG. 2 taken together illustrate a preferred embodiment of the handwasher of this invention in which housing 10, comprising a metallic sheath supported by side walls of transparent plastic, is mounted on a base means for removably supporting said handwasher on an extended surface, said means for supporting comprising a base structure which includes at least one suction cup 12. Access-opening 14 is provided in housing 10 for insertion of a hand or the like through a hand-penetrable barrier 16 for confining liquid spray and the like, said barrier comprising a plurality of deformable setaceous elements mounted on periphery member 18 of access-opening 14. Fluid-energized motor 22, supported within housing 10 as by mounting bolts 20, has an inlet 24 connected ot one end of conduit 26 whose other end, not shown, receives a stream of liquid under pressure. Said stream of liquid energizes said motor in transit therethrough and thereafter flows through hollow conduit 30 having radially-directed outlets 32, said conduit 30 arranged as a rotational shaft mechanically coupled at its proximal end to a rotational member 40 of motor 22 as by coupling pin 28.

At least one laving member 34 is mounted on the exterior of hollow conduit 30 with its laving surface 36 directed radially outwardly, said laving surface 36 defined by the outer terminal-ends of a plurality of bristle-like elements 38. The distal end of hollow conduit 30 is supported for rotation on an outboard bearing comprising a bearing pin 44 projecting through housing 10, said bearing pin engaging a depressed portion of closure 46 for the distal end of hollow shaft 30.

In the operation of this embodiment of the invention, liquid under pressure from conduit 26 energizes motor 22, activating the rotation of rotational member 40 and driving hollow conduit 30 coupled thereto. Liquid, exiting motor 22, traverses hollow conduit 30 and exits therefrom via a plurality of spaced-apart radially directed outlet 32. The rotational motion of hollow conduit 30 causes liquid emitted from said outlets 32 to interact in wetting relationship with rotating said laving member 34.

Access-opening 14 is located in housing 10 in relationship to the axis of rotation of laving member 34 so as to facilitate the contacting with laving surface 36 of a terminal-end portion of an elongated member inserted therethrough.

Liquid, confined and collected within housing 10, is vented therefrom through drain 48 located at a low point of housing 10.

A solid cleansing agent, such a soap bar 50, can be provided within housing 10 by suspending said bar from hook 52, as illustrated by enclosure in an open-mesh bag 54 of plastic or the like. An alternate preferred means of support for soap bar 50 is to use a specially prepared bar of soap having the ends of a string embedded therein to form a loop for suspension on hook 52. Other means and methods for providing washing compound, cleansing agent, and the like will be described hereinafter.

Figure 3:
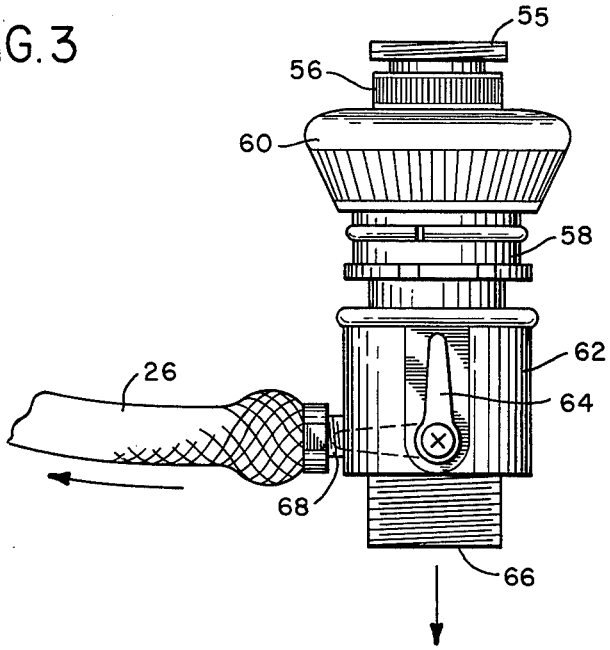
FIG. 3 is an elevation view of a physical-disconnect and flow-diversion valve termination for a conduit supplying liquid under pressure to the handwasher of this invention when adapted for use with a household water supply at a kitchen sink or lavoratory sink.

A preferred physical-disconnect and flow-diversion valve termination for the end of conduit 26 not shown in FIG. 1 and FIG. 2 is shown in FIG. 3 wherein said termination, adapted for use in conjunction with a household water supply at a kitchen or lavoratory sink having a conventional water faucet with threads for connection of an aerator and the like, comprises: adapter fitting 55, having external threads at both ends, for use when said faucet has female threads for the connection of a commercially available quick-couple physical-disconnect of the type used with portable dishwashers and the like; a quick-couple physical-disconnect made up of male member 56 with female threads and a female member 58 removably attachable to said male member 56 and secured thereto by the bias of slidable collar 60 acting on internal ball-detents; and a two- position valve 62 of the type having a handle 64 rotatable in the direction of the arrow between a first position in which flow therethrough exits at a first exit 66 and a second position, shown by the broken line outline of handle 64, in which flow exits valve 62 at a second exit 68, said second exit 68 connected to conduit 26.

Figure 3A:
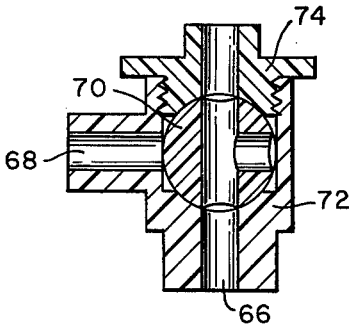
FIG. 3*a* is a cross-section elevation view of a two-position ball-valve.

A two-position ball-valve adapted to use as a flow-diversion valve in the practice of this invention is shown in cross-section in FIG. 3*a* wherein the cross-section plane is perpendicular to the axis of rotation of ball 70 which has a birfucate passageway therein. Ball 70 is captively engaged by a valve body, made up of two body members 72 and 74, said valve body internally contoured to allow rotation of ball 70 around said axis of rotation. A handle means for manually rotating said ball 70, not shown, is constrained by interaction with said valve body, as is known in the art, to limit the rotation of ball 70 between a first position, as illustrated, and a second position 90° counterclockwise, whereby said bifurcate passageway is open to second exit 68.

Figure 3B:
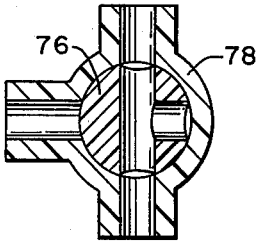
FIG. 3*b* is a cross-section elevation view of a two-position stop-cock valve.

FIG. 3*b* shows an alternative type of flow-diversion valve in cross-section taken on a plane at right angle to the axis of rotation of barrel 76 of this stop-cock type valve. Barrel 76 is of frustro-conical shape with a bifurcate passageway therein, said passageway orthogonal to said axis of rotation. Barrel 76 is captively engaged in valve body 78 by means known in the art and not shown. Valve body 78 has alternative exits and means known in the art for limiting rotation of said barrel so that said bifurcate passageway aligns with a one or the other of said alternative exits.

Figure 3C:
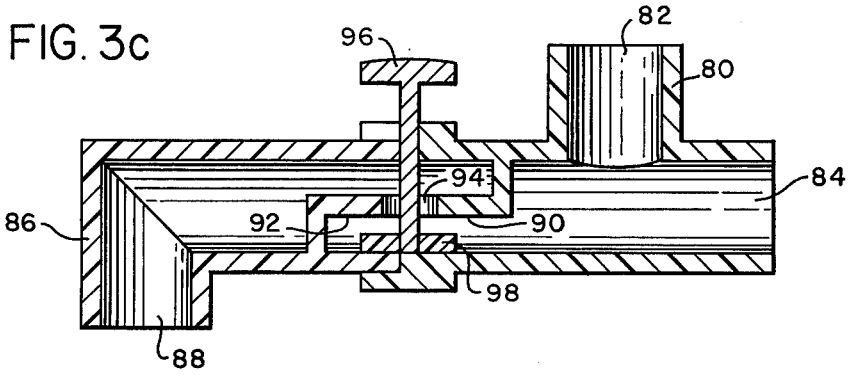
FIG. 3*c* is a cross-section elevation view of a fail-safe flow-diversion valve.

FIG. 3*c* shows a cross-sectional elevation view of a fail-safe type flow-diversion valve having a two-component body in which a first body component 80, having a liquid entrance 82 and a liquid exit 84 is mated with a second body component 86 having an outlet 88. The mating ends of first body component 80 and second body component 86 include projecting valve seat elements 90 and 92 which cooperate to define the walls of a labyrinthian passageway having a vertical passage section 94 closable by manually raising weighted valve-stem 96 until sealing member 98 at the lower end thereof is brought into sealing relationship with the lower surfaces of the said valve seat elements. In the operation of this fail-safe flow-diversion valve, a stream of liquid under pressure, entering at entrance 82, discharges from outlet 88 whenever the back-pressure at exit 84 is greater than the pressure drop generated by flow through the said labyrinthian passageway. When sealing member 98 has been brought into sealing relationship with valve seat elements 90 and 92, closure of vertical passage section 94, so effected, is maintained by the dynamic back-pressure of the stream of liquid flowing through exit 84 to a positive-displacement motor of this invention.

Thus, when liquid entrance 82 is coupled to receive liquid, as water from a faucet, and exit 84 is connected to conduit 26 providing liquid to the handwasher of this invention and liquid is flowing through outlet 88, initiation of flow of liquid of said handwasher is accomplished by the manual lifting of valve stem 96 to close off vertical passage section 94. The dynamic back-pressure of positive-displacement motor 22 is sufficient to maintain closure of vertical passage section 94 until the flow of liquid entering liquid entrance 82 is stopped. The loss of pressure resulting from the cessation of flow allows weighted valve stem 96 to drop, reopening vertical passage section 94 and resetting the valve to its original mode of operation for flow of liquid out of exit 88.

The fail-safe feature of this flow-diversion valve prevents inadvertent admission of scalding water to the handwasher, since the temperature of the water may be adjusted as desired prior to the manual initiation of flow to the handwasher.

Figure 4:
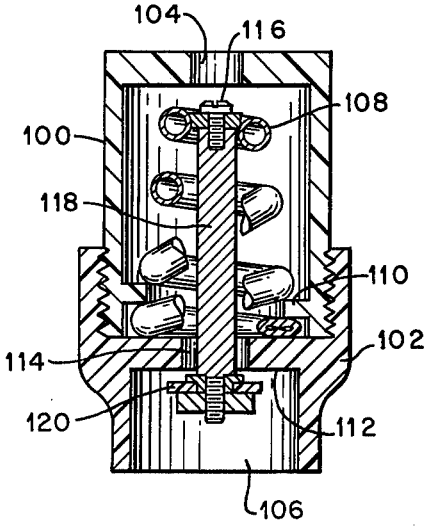
FIG. 4 is a cross-section elevation view of a thermally-activated shut-off valve.

As an additional safety feature, a thermally activated shut-off valve can be provided intermediate the flow-diversion valve and the handwasher of this invention to shut off liquid flow when the temperature of said liquid is above a preselected temperature. FIG. 4 illustrates a thermally activated shutoff valve suitable for insertion in conduit 26, said shut-off valve similar to the thermostat valve in an automotive engine cooling system except that this normally open valve shuts in response to high temperature. A first body member 100, coupled to a second body member 102, provides an inlet for liquid flow 104 and an outlet for liquid flow 106. Hollow expansion-tube 108, having closed ends, is arranged as a helix with a first-end portion captively engaged between an inwardly projecting ledge member 110 of body member 100 and an inwardly projecting valve-seat member 112 of body member 102, said valve-seat member 112 having an axially located passage for fluid 114, the second-end portion of expansion tube 108 being secured as with screw fastener 116 to a first end of shaft 118, said shaft passing through said passage for fluid 114 and terminating at a second end having a valve-closure member 120 secured thereon. Heat-activated expansion of expansion-tube 108 urges valve-closure member 120 into closing contact with valve-seat member 112, preventing flow through passage for fluid 114.

Figure 5:
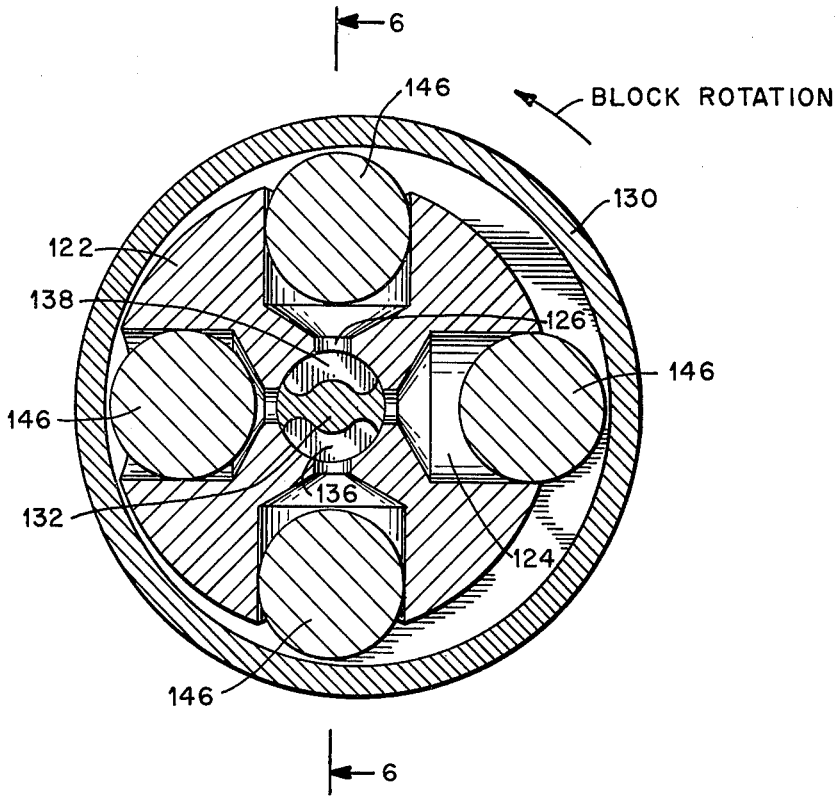
FIG. 5 is a cross-section end view of a positive-displacement fluid-energized motor of this invention.
Figure 6:
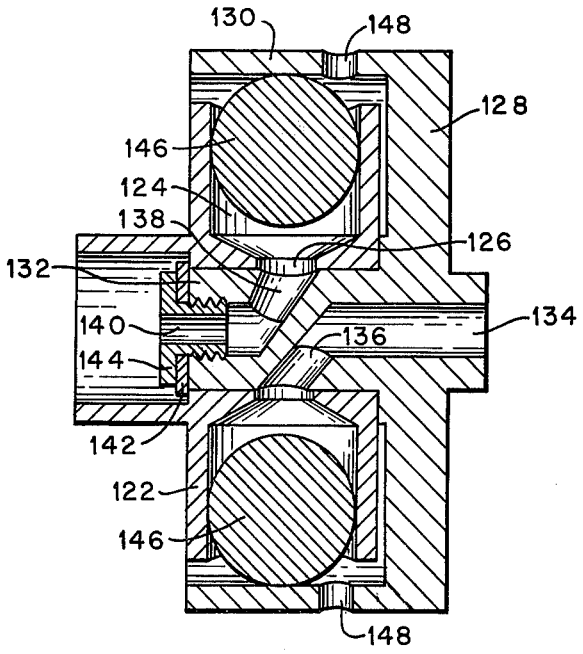
FIG. 6 is a sectional view taken along the plane at 6—6 of FIG. 5.

Two views of a fluid-energized positive-displacement motor of particular utility in the handwasher of this invention are shown in FIG. 5 and FIG. 6, wherein piston block 122 has an axial cylindrical through-bore and a plurality of outwardly opening equi-length radially disposed piston chambers 124 disposed symmetrically orthogonally to said bore, each of said piston chambers 124 interconnected with said bore by a radially extending passageway 126. External to said piston block 122 is a vented casing 128 having a reaction ring 130 with an inner-wall section in the form of a right circular cylinder, said reaction ring 130 having a center, said casing including a cylindrical pintle 132 located off said center on a diameter of said circular cylinder, said pintle 132 extending parallel to said inner-wall section of said reaction ring 130. Pintle 132 includes an entrance passage for fluid flow interconnecting fluid entrance 134 with radially opening entrance port 136, and a separate exit passage for fluid flow interconnecting radially opening exit port 138 with fluid exit 140.

Entrance port 136 and exit port 138 are located in opposed symmetric relationship on a common diameter of pintle 132, each said port of a size such that the circumferentially extending surface of pintle 132 therebetween is sufficient to completely close off a said passageway 126 when said through-bore of piston block 122 is mounted in rotational engagement with said pintle 132 and a said passageway 126 is aligned orthogonally to said common diameter. Piston block 122 is captively restrained from axial movement along pintle 132 by causing 128, washer 142, and hollow thrust-bolt 144, threadably engaged with pintle 132. A movable piston, comprising a ball 146, rides in each of said piston chambers captively engaged between said piston block and said reaction ring.

When the perimeter of the cross-section of each of said piston chambers 124 is a circle, ball 146 is selected of a close dimensional tolerance, as is known in the art, to limit leakage of fluid between said ball and said piston block. A plurality of vents 148 are located in casing 128 to permit the free drainage of fluid which unavoidably leaks past the pistons during operation of said motor and the leakage of fluid subsequent said operation when slow seepage is more apt to occur.

When a flow of fluid under pressure is supplied to fluid entrance 134 and casing 128 is restrained from rotational motion, as by fastening to a support structure, not shown in FIG. 6, piston block 122 rotates to provide rotational power. In this mode of operation, fluid under pressure is selectively and sequentially directed into each of the said piston chambers in outwardly urging relationship to the pistons and the said fluid in each of the said piston chambers is selectively and sequentially directed to fluid exit 140 in response to inward urging of each of said pistons.

Figure 7:
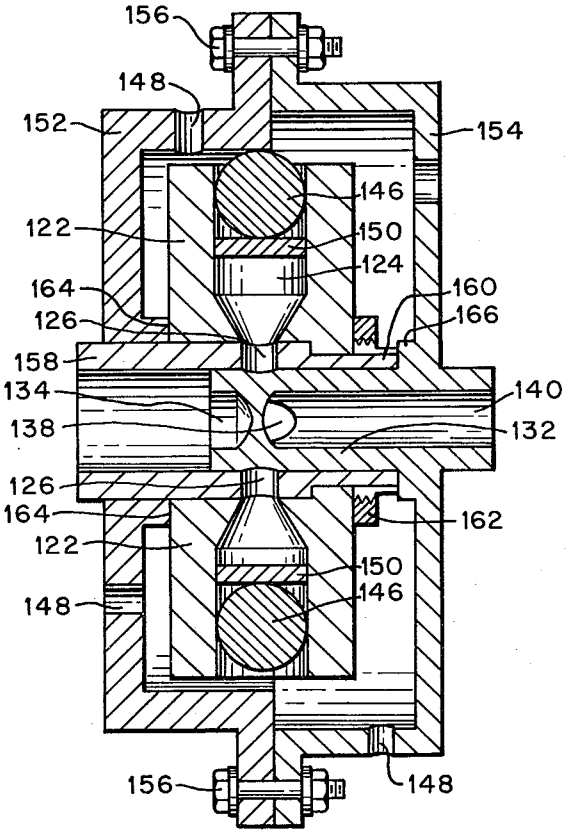
FIG. 7 is a cross-sectional view of a fluid-energized positive-displacement motor having pistons comprising balls and follower-discs.

FIG. 7 illustrates another embodiment of the positive-displacement motor of this invention wherein the pistons within symmetrically disposed equi-length radial piston chambers 124 each comprise a ball 146 and a follower-disc 150, said pistons constrained to motion within said piston chambers by reaction ring 130 defined by a segmented, vented outer casing comprising a first segment 152 with vents 148 and a second segment 154 with vents 148, joined together as by bolted fasteners 156.

Hollow shaft 158, mated with piston block 122, as by keyway 160 and threaded retaining ring 162, provides a radially extending passageway 126 for each of said piston chambers 124. Said hollow shaft 158 has a through-bore adapted to rotational engagement with pintle 132 of second segment 154. Said pintle 132 has a fluid entrance 134, a radially opening entrance port, interconnected therewith and not shown in this view, and a separate exit passage for fluid flow interconnecting radially opening exit port 138 with fluid exit 140.

Assembly of the motor of FIG. 7 is accomplished by: mating piston block 122 with hollow shaft 158, utilizing keyway 160 and threaded retaining ring 162 to secure said block to said shaft and to prevent both axial and rotational movement of piston block 122 on hollow shaft 158; inserting a follower disc 150 and then a ball 146 into each of piston chambers 124; captively retaining said follower-disc and said ball in said piston chambers by sliding first segment 152 on shaft 158 until retaining ring 130 confronts piston chambers 124 and bearing surface 164 bears against piston block 122; then, inserting pintle 132 of second segment 154 into hollow shaft 158 until flanged bearing member 166 bears against the end of hollow shaft 158; and, finally, aligning and joining together said first segment 152 and said second segment 154 as by bolting fasteners 156. When fluid under pressure is supplied to fluid entrance 134 and hollow shaft 158 is constrained from rotation, as by securing to a housing not shown, said outer casing rotates and provides rotational power to any element connected thereto.

When the positive-displacement motor of this invention is operated in the above described mode, said motor is best characterized as comprising non-rotary pistons and a rotational reaction ring. When operated in the alternate mode, with said outer casing constrained from rotation, said motor can be characterized as having rotary pistons.

In a positive-displacement motor of the type described, use of pistons comprising a ball and a follower-disc is of special advantage because the use of a follower-disc removes the requirement for precision tolerance in the dimensions of ball 146, which tolerance is difficult to achieve without high cost. Follower-disc 150 can be produced in volume to high precision at low cost.

Additionally, when a piston comprising a ball and a follower-disc is used, the piston chamber can have a cross-section perimeter which is not limited to a circle and can be any rectilinear or arcuate closed figure in which a circle can be inscribed.

Figure 9:
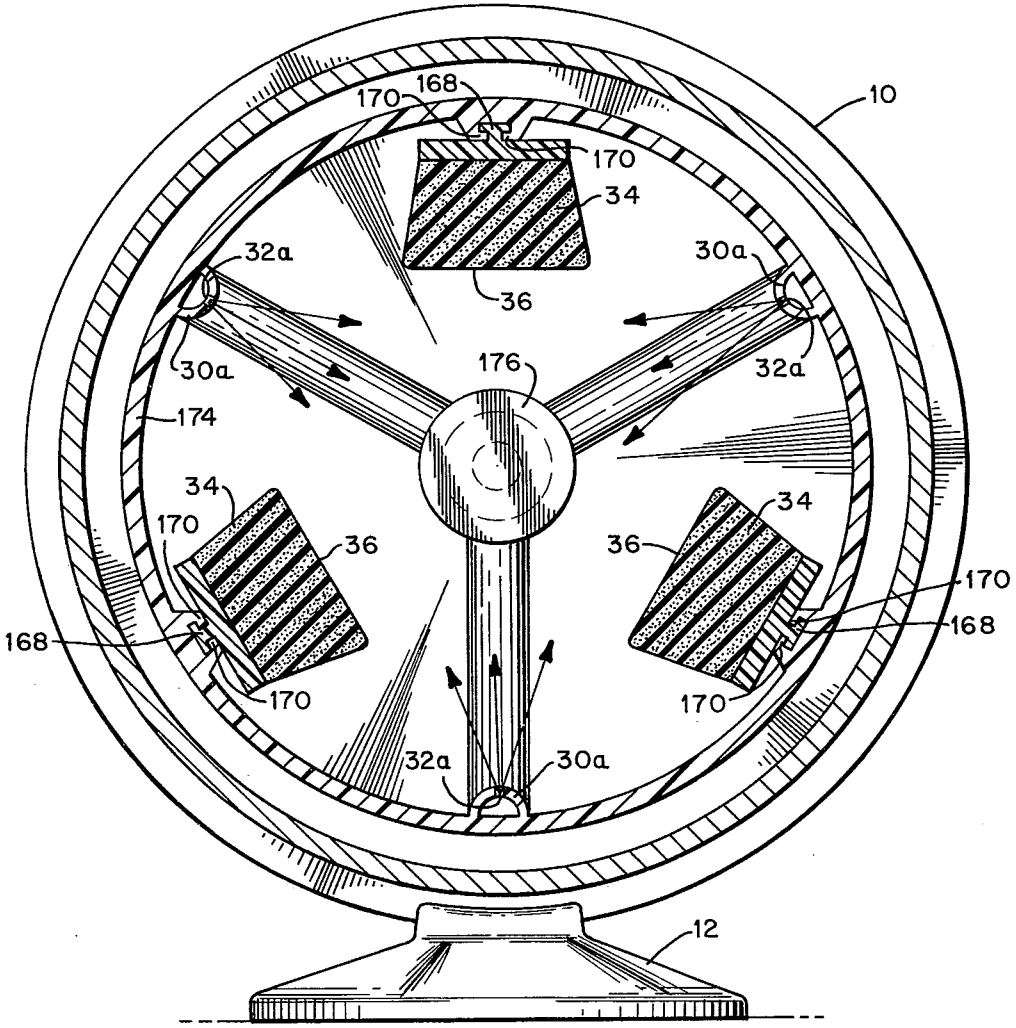
FIG. 9 is a sectional view taken along the plane at 9—9 of FIG. 8.
Figure 8:
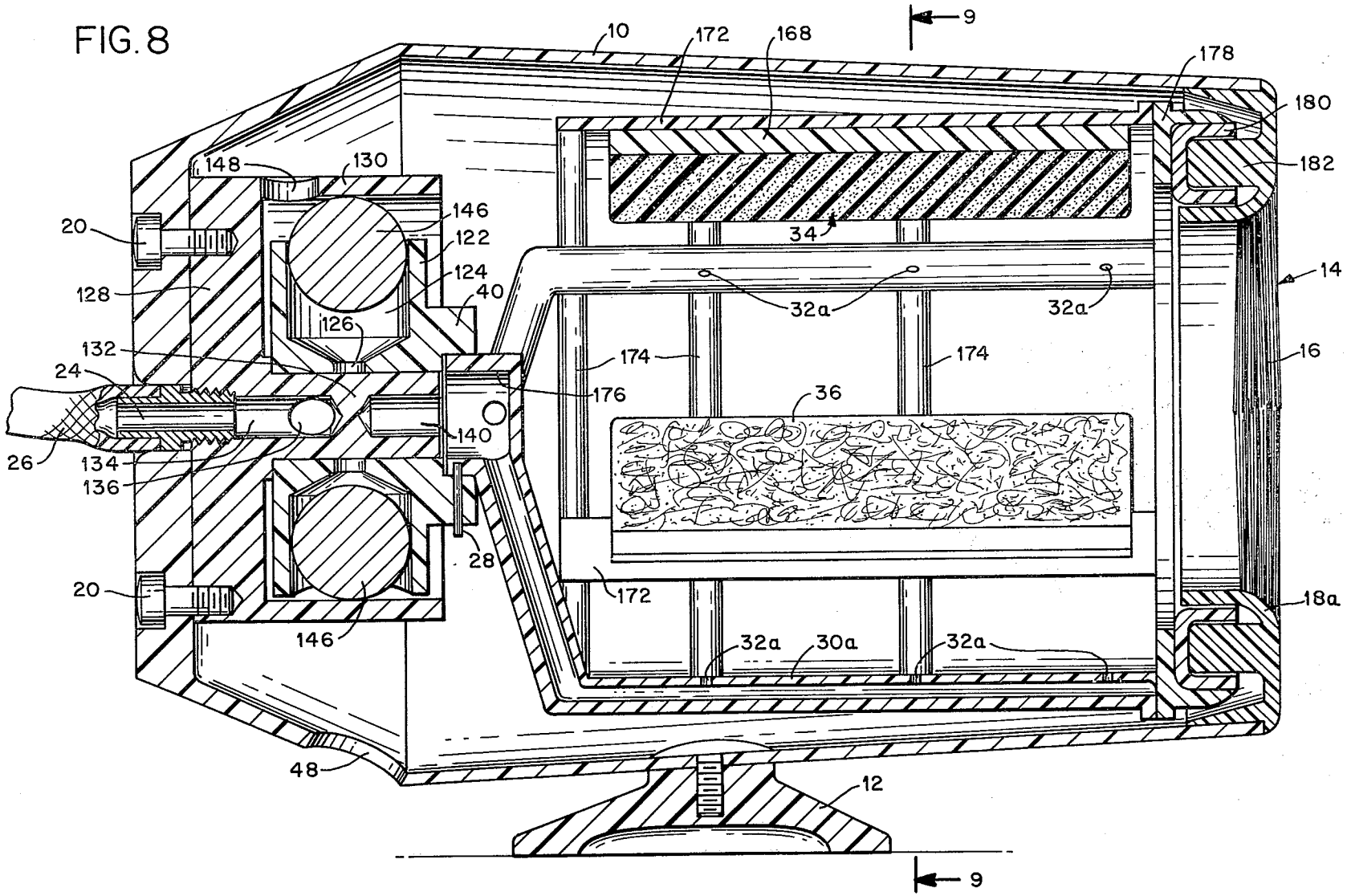
FIG. 8 is a cross-sectional elevation view of a handwasher having radially-inwardly directed laving members.

FIG. 8 and FIG. 9, taken together, illustrate a preferred embodiment of the handwashing device of this invention wherein the laving surface 36 of each laving member 34 of a plurality of symmetrically spaced laving members is directed radially inwardly. In this embodiment, means defining a laving member 34 comprises sponge-like elements bonded to a laving means support member 168, said support member 168 including a transversely extending flange portion adapted to captive engagement in an elongated longitudinally extending channel defined by a pair of spaced-apart opposed channel sidewall members 170 of a one of longeron members 172 of a perforate basket made up of a plurality of spaced-apart hoop members 174 and longerons, said longerons comprising a plurality of symmetrically disposed said longeron members 172 and a plurality of symmetrically disposed hollow conduits 30*a* having radially-directed outlets 32*a*. Said hollow conduits 30*a* interconnect with a plenum defined by hollow hub 176, said hub mechanically coupled, as by coupling-pin 28, to and driven by rotational member 40 of a fluid-energized positive-displacement motor having rotary pistons, said motor supported in housing 10 of synthetic plastic by mounting bolts 20.

In this embodiment, an outboard thrust-bearing is provided by captive engagement of a plurality of bearing members between flanged hoop 178, forming the rim of said perforate basket, and an inwardly depending lip of periphery member 18*a* of access-opening 14 of housing 10, said access-opening having a hand-penetrable barrier 16. In FIG. 8, the said bearing members are shown as comprising a cup-shaped member 180 rotationally supported on a peg 182, said peg projecting inwardly from periphery member 18*a*. An alternative construction for said outboard thrust-bearing not shown utilizes a plurality of spherical bearing members captively engaged between said flanged hoop 178 and said periphery member 18*a* which cooperate to form a bearing race as is well known in the art.

Figure 10:
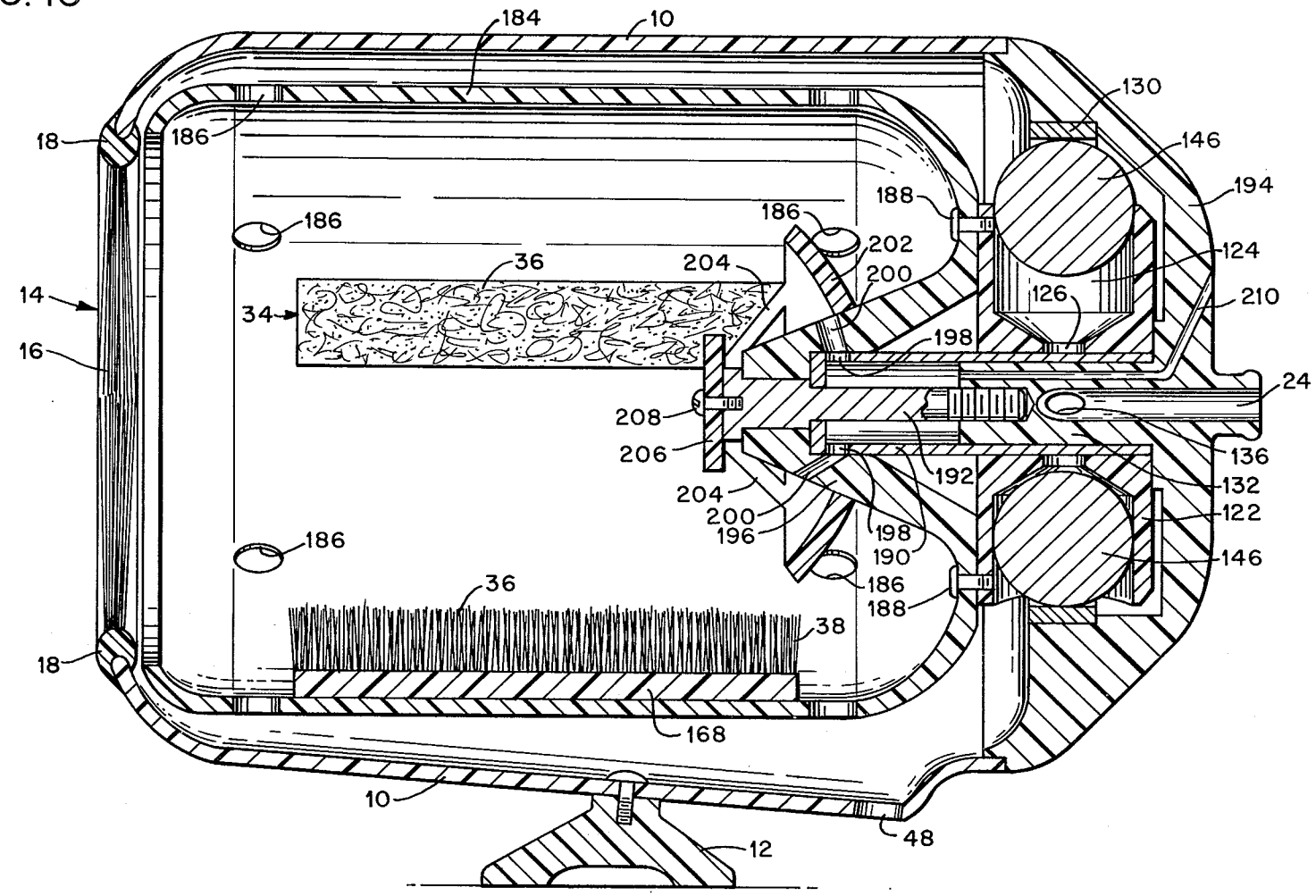
FIG. 10 is a cross-sectional elevation view of an embodiment of the handwasher of this invention having a perforate bowl supported for rotation as a cantilever structure.

FIG. 10 shows a still further embodiment of the handwasher of this invention having symmetrically spaced radially inwardly directed laving surfaces wherein the laving surface 36 of each laving member 34 comprises the terminal-end portions of bristle-like elements bonded to laving means support member 168, said laving means support member including means heretofore described for mounting said laving member on the interior surface of a perforate bowl 184, said bowl having a plurality of perforations 186 in the walls thereof. Bowl 184 is supported for rotation as a cantilever structure from the substantially closed end thereof at a journal portion 196 and by attachment as with bolts 188 to piston block 122 of a rotary-piston motor of this invention, said journal portion adapted to bearing against the bearing surfaces of pintle sheath 190 and pintle bolt 192.

Housing 10 includes motor-casing section 194 adapted to the mounting therein of pintle sheath 190 and reaction ring 130, said motor-casing section including a channeled pintle 132 and means for attaching a conduit for providing a stream of liquid under pressure to inlet 24. Pintle bolt 192 threadably connects with said motor-casing section 194 to immobilize pintle sheath 190 and to captively engage journal portion 196 in rotational engagement with the bearing surfaces of said pintle sheath and said pintle bolt. Pintle sheath 190 has openings for a radially opening entrance port 136, a radially opening exit port not shown in this view, and a plurality of radial outlets 198. Journal portion 196 includes a plurality of radial channels 200 adapted to interaction and diversion of the liquid exiting said outlets 198 as said channels successively align with said outlets during rotation of said journal portion.

An arcuate deflector ring 202, supported by struts 204 from a nave section 206 mounted on pintle bolt 192 as by screw fastener 208, is positioned opposite channels 200 so as to generate spray by impingement thereon of liquid exiting said channels, said spray interacting in wetting relationship with each said laving member 34.

Motor-casing section 194 includes a channel for liquid cleansing agent 210, said channel permits feeding liquid soap and the like through pintle 132 into the stream of liquid which has exited piston chambers 124. A wide variety of means obvious to those skilled in the art are available for introducing liquid cleansing agent under pressure into channel 210. For example, it would be obvious to modify a squeeze bottle or a pumped-equipped bottle of the type used in the average home for dispensing liquid condiments, hand lotions, and the like, said bottle modified by the addition of an exit conduit adapted to insertion in channel 210. Motor-casing section 194 can be modified as required to provide a support for a squeeze bottle and the like, as would be obvious to one skilled in the art.

Figure 11:
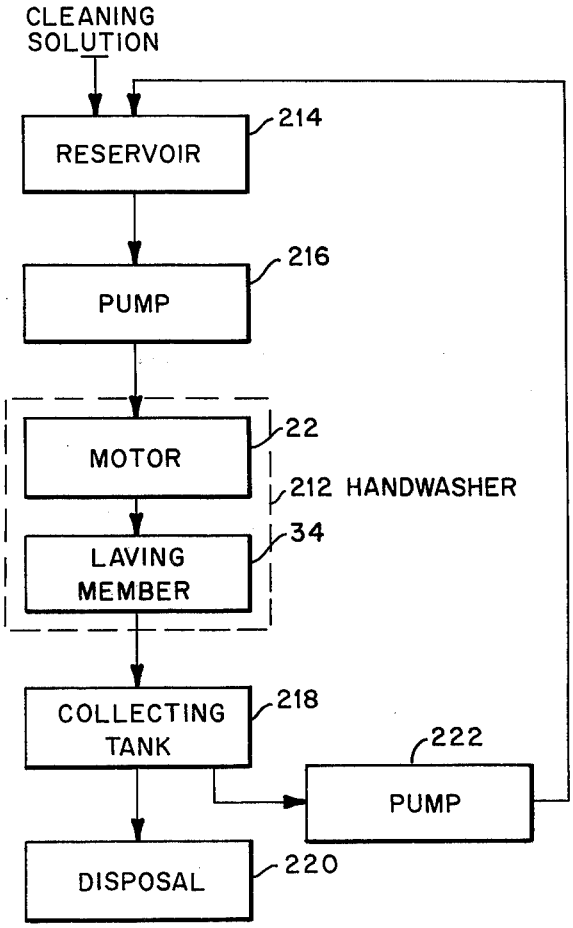
FIG. 11 is a block diagram of a cleaning system comprising the handwasher of this invention.

Referring now to FIG. 11, wherein a cleaning system comprising a handwasher of this invention is depicted in block diagram flow sheet, with said handwasher indicated by the elements enclosed within broken line block 212 and the flow of cleaning solution as indicated by the arrowheads on the lines connecting the blocks, reservoir 214 is provided for storage of cleaning solution, said solution supplied from a source not shown which includes individual shipping containers and the like of proprietary cleaners, organic solvents and the like. A means for providing a stream of said cleaning solution under pressure, as pump 216, is coupled to said reservoir to supply a stream of liquid to handwasher 212 where the said stream of liquid first energizes motor 22 in transit therethrough and then interacts in wetting relationship with laving member 34, said handwasher including motor 22 and laving member 34 heretofore fully described and illustrated. Alternative means for pressurizing a stream of said cleaning solution exiting said reservoir 214 includes methods and means well known in the art such as the elevation of reservoir 214 above handwasher 212 a sufficient distance to provide a desired liquid head, and such an expedient as providing a pressurized volume of gas above the free surface of the cleaning solution as by pumping in liquid to a sealed said reservoir. Cleaning solution exiting handwasher 212 is directed to collecting tank 218 from whence it can be selectively directed to disposal 220 or returned to reservoir 214, as by pump 222.

When water is the said cleaning solution of the cleaning system of FIG. 11, and reservoir 214 is a source of potable water, all liquid exiting handwasher 212 can bypass collecting tank 218 and be directed directly to disposal 220, which disposal may be a sewer, septic-tank, cess-pool and the like.

When the said cleaning solution is an organic solvent and the soil to be removed from a soiled surface contacting said laving member in laving relationship comprises solvent-soluble as well as solvent-insoluble components, said collecting tank 218 is advantageously provided with means known in the art for settling out the said solvent-insoluble components prior to the return of clarified said solvent to reservoir 214. Periodic removal of sludge from collecting tank 218 to disposal 220 serves to prolong the economically useful life of said solvent. Means known in the art, such as distillation, can be used as desired for repurification of said solvent whenever the concentration of soil dissolved therein reaches a predetermined value.

When the said cleaning solution is a proprietary solution of the type used for the removal of surface contamination comprising noxious chemicals and the like, disposal 220 can include isolation in containers, as is known in the art, to minimize likelihood of environmental contamination.

Whereas, water organic solvent, and proprietary solution have been discussed above as having particular utility in the practice of this invention, this list should not be construed as limiting inasmuch as many other liquids can be used, including: soap solution; detergent solution; solution of chelating agent; solution of sequesting agent; and germicide solution. These and other solutions can be used alone and in combination as desired.

Whereas, for convenience in the graphic presentation, the reaction ring of the fluid-energized positive-displacement motor of this invention has been depicted in the various views of the drawings as having an inner circumference in the form of a circle, it will be obvious to those skilled in the art that a circle is but one of the many possible configurations for the said inner circumference. What is meant by the appelation reaction ring in this specification and the appended claims is an upstanding wall member having an inner surface whose projection on a plane normal thereto is a closed arcuate figure, said arcuate figure being the path traced on said plane by a point moving in reciprocating motion between a first locus and a second locus along a radius of a circle, said circle having its center on an axis of said arcuate figure, said radius rotating in said plane such that said point is at a said locus only when said radius coincides with said axis. Further, it should be understood that the said center defines the axis of rotation of the rotary element of the motor of this invention.

Whereas, in asserting utility, the instant invention has been described primarily as a handwashing device, and it will be obvious to those skilled in the art to apply the teachings of this invention to an industrial environment for the cleaning of the terminal-end portion of an elongated member other than a hand and the like, it should, therefore, be understood that the appelation handwasher is but descriptive of one use for the device of this invention and should not be construed as limiting.

Although other positive-displacement motors known in the art can be used in the industrial applications of this invention where it is possible to design a source of liquid for energizing said motors so as to have an adequate pressure and an adequate flow rate, the fluid-energized positive-displacement motor of this invention having pistons comprising balls is preferred because of its inherently high efficiency, and is of special advantage when used with a household water supply where both pressure and flow rate are apt to be limiting. In this context, the use of vents in the casing of the motor of this invention has been found to be critical to successful operation with a marginal water supply. Thus, the motor of this invention illustrated in FIG. 5 when used in the handwasher of FIG. 1 and FIG. 2 and supplied with water at a pressure of about 30 pounds per square inch at a flow rate of 1-gallon per minute ran at about 245 revolutions per minute, said motor having a one-inch diameter piston chamber and three-tenths inch stroke. The maximum energy available under these conditions is about 1/50 horsepower. By increasing the flow rate and/or pressure about 1/15 horsepower is obtainable with the same motor.

In addition to the advantage of high inherent efficiency, the motor of this invention can be stalled without suffering damage and will always restart immediately upon removal of the stalling force. Also, since the speed of the motor is substantially completely determined by the cross-sectional area of the piston chamber, the piston stroke, and the volumetric flow rate of the energizing fluid, the motor can be sized easily to provide a desired rotational speed which permits direct drive without need for reduction gears and the like.

Whereas, in the various figures of the drawings various elements of this invention have been lined in sectional views to show a material of construction which in one embodiment may be plastic and in another embodiment may be metal, such indication of material should not be construed as limiting since either material can be used substantially interchangeably, as is known in the art, provided selection and modification not amounting to invention is made for the known differences in structural and mechanical properties and response to chemical attack.

Now, having described the invention and the manner and process of making and using it, in full, clear, concise and exact terms so that one skilled in the art can make and use same, and having set forth the best mode contemplated by the inventors of carrying out this invention in accordance with the statute, and aware that many variations of the invention can be practiced without departing from the spirit and the teachings of this specification the inventors do not want to be limited by the specification but only by the appended claims.

What is claimed is:

1. A fluid energized washing device for cleaning the terminal end of an elongated member, comprising in combination:

means for providing a stream of fluid under pressure;

fluid energized motor means for providing rotational power, said motor means activated by said stream of liquid under pressure, said motor means having in combination means defining a vented casing, vented to ambient having an inner wall section in the form of a reaction ring, means defining a piston blockhaving a plurality of equi-length radially disposed piston chambers radially interconnected to a central axial bore, means defining a piston for each of said piston chambers, means for directing fluid under pressure selectively into each of said piston chambers in outwardly urging relationship to said piston and for selectively and sequentially directing the flow of said fluid from each of said piston chambers to an exit means in response to inward urging of said piston, any said fluid under pressure escaping past a said piston being vented to ambient independent of said means for directing fluid under pressure to maintain the space between said piston block and said reaction ring substantially free of said fluid, means mounting said piston block in said casing and means for constraining one of said piston block and said reaction ring from rotational motion whereby rotational motion is developed between said piston block and said reaction ring provided at least one said piston is in urging relationship with said reaction ring;

means defining a laving member rotationally driven by said motor means wherein said laving member is a hollow conduit driveably rotatably mounted on said motor means having laving elements mounted along the inner wall thereof;

means for interacting said stream of fluid after said stream of fluid has exited through said exit means with said laving member so as to wet said laving member, said means for interacting comprising a hollow conduit having radially directed outlets;

means for facilitating the contacting of said terminal-end portion of said elongated member with said laving member in a laving relationship;

housing means for enclosing and supporting said motor means and said laving means, said housing means including a drain for fluid collected therein and an access opening adapted to the insertion therethrough of at least the terminal-end portion of the elongated member to contact said laving means;

and, base means for supporting said housing means on an extended surface.

2. The invention of claim 1 wherein said fluid is water and the terminal end of the elongated member is a human hand.

3. The invention of claim 2 wherein said laving member comprises bristle elements to facilitate laving.

4. The invention of claim 3 wherein said laving member is in the form of a rotatable cup having bristle elements radiating inwardly from the cup walls.

5. The invention of claim 4 wherein said housing means includes means for providing a water-dispersible cleaning compound onto said bristle elements.

6. The invention of claim 5 wherein means for providing a stream of water under pressure is coupled to a sink faucet with means for selectively adjusting the flow rate and the temperature of said water exiting from the sink and entering the invention.

7. The invention of claim 6 wherein the hollow conduit is driveably mounted on the motor means at its proximal end and is rotably mounted at its distal end into the housing.

8. The invention of claim 7 wherein the distal end of the hollow conduit contains a deformable penetrable shield means to prevent water from splashing out of the housing therethrough.

9. The invention of claim 8 wherein the shield means is in the form of bristles.

* * * * *